US009147944B2

(12) United States Patent
Aizawa et al.

(10) Patent No.: US 9,147,944 B2
(45) Date of Patent: Sep. 29, 2015

(54) TERMINAL FITTING

(71) Applicants: AUTONETWORKS TECHNOLOGIES, LTD, Yokkaichi-shi, Mie (JP); SUMITOMO WIRING SYSTEMS, LTD., Yokkaichi-shi, Mie (JP); SUMITOMO ELECTRIC INDUSTRIES, LTD., Osaka-shi, Osaka (JP)

(72) Inventors: Takeshi Aizawa, Yokkaichi (JP); Satoshi Morikawa, Yokkaichi (JP); Yoshihiro Uchiyama, Yokkaichi (JP); Kazuaki Takeda, Yokkachi (JP); Takashi Tonosaki, Yokkaichi (JP)

(73) Assignees: AUTONETWORKS TECHNOLOGIES, LTD. (JP); SUMITOMO WIRING SYSTEMS, LTD. (JP); SUMITOMO ELECTRIC INDUSTRIES, LTD. (JP)

( * ) Notice: Subject to any disclaimer, the term of this patent is extended or adjusted under 35 U.S.C. 154(b) by 0 days.

(21) Appl. No.: 14/373,189

(22) PCT Filed: Dec. 12, 2012

(86) PCT No.: PCT/JP2012/082146
§ 371 (c)(1),
(2) Date: Jul. 18, 2014

(87) PCT Pub. No.: WO2013/111465
PCT Pub. Date: Aug. 1, 2013

(65) Prior Publication Data

US 2015/0244084 A1 Aug. 27, 2015

(30) Foreign Application Priority Data

Jan. 23, 2012 (JP) ..... 2012-11013

(51) Int. Cl.
*H01R 4/18* (2006.01)

(52) U.S. Cl.
CPC . *H01R 4/184* (2013.01); *H01R 4/18* (2013.01)

(58) Field of Classification Search
CPC ..... H01R 4/184
See application file for complete search history.

(56) References Cited

U.S. PATENT DOCUMENTS 3,781,459 A * 12/1973 Peek ..... 174/94 R
5,245,132 A * 9/1993 Luetzow ..... 174/74 R (Continued)

FOREIGN PATENT DOCUMENTS

JP 60-35471 3/1985
JP 61-48658 4/1986
JP 64-043980 2/1989

(Continued)

OTHER PUBLICATIONS

International Search Report dated Feb. 26, 2013.

(Continued)

*Primary Examiner* — James Harvey
(74) *Attorney, Agent, or Firm* — Gerald E. Hespos; Michael J. Porco; Matthew T. Hespos

(57) ABSTRACT

A female terminal fitting (20) is to be crimped to a wire including a core (12) formed by plural strands (11) and includes a bottom plate (22) on which the core (12) is to be placed, and a pair of crimping pieces (25L, 25R) connected to the bottom plate (22) and to be crimped to the core (12) in such a manner as to embrace the core (12) placed on the bottom plate (22). Butting parts of the respective crimping pieces (25L, 25R) are formed with a thinning portion (27), and a corner portion (30) is formed by deforming the thinning portion (27) when the respective crimping pieces (25L, 25R) are crimped to the core (12). Accordingly, a clearance formed at the butting parts of the respective crimping pieces (25L, 25R) can be made smaller than in the case where the thinning portions (27) are not provided.

6 Claims, 6 Drawing Sheets

(56) References Cited

U.S. PATENT DOCUMENTS

| | | | | |
|---|---|---|---|---|
| 6,059,616 | A | 5/2000 | Bluemmel et al. | |
| 7,306,495 | B2 | 12/2007 | Hashimoto et al. | |
| 9,054,431 | B2 * | 6/2015 | Endo | 1/1 |
| 2001/0016460 | A1 * | 8/2001 | Koide | 439/877 |
| 2009/0137144 | A1 | 5/2009 | Onuma | |
| 2011/0067239 | A1 * | 3/2011 | Martauz et al. | 29/885 |

FOREIGN PATENT DOCUMENTS

| | | |
|---|---|---|
| JP | 11-238532 | 8/1999 |
| JP | 2005-50736 | 2/2005 |
| JP | 2009-152162 | 7/2009 |

OTHER PUBLICATIONS

Written Opinion Report dated Feb. 26, 2014.

* cited by examiner

TERMINAL FITTING

BACKGROUND OF THE INVENTION

1. Field of the Invention

The present invention relates to a terminal fitting to be crimped to a wire including a core formed by putting a plurality of strands together.

2. Description of the Related Art

In recent years, aluminum wires have been used for the purpose of weight reduction and the like also in the field of automotive wiring harnesses and the like. An aluminum wire is, for example, structured such that a core formed by twisting a plurality of aluminum strands is covered by an insulation coating, and a terminal fitting is generally connected to an end of the wire when the wire is assembled into a wiring harness. Specifically, an end of the coating of the aluminum wire is removed to expose an end of the core, a wire barrel (wire connecting portion) provided on the terminal fitting is crimped to the exposed end of the core, and an insulation barrel provided behind the wire barrel is crimped and connected to an end of the remaining insulation coating (see, for example, Japanese Unexamined Patent Publication No. 2005-50736). Such a terminal fitting is formed by press-working a metal plate with good electrical conductivity.

However, since the wire barrel is crimped such that the tips thereof are bent inwardly and pushed into between the twisted strands while being butted against each other in the above terminal fitting, contact parts of the wire barrel are rounded and a clearance is easily formed between these. If a waterproofing treatment is performed by covering the wire barrel with a resin material, the resin material enters the clearance to thicken the resin material and the resin material cannot have a uniform thickness as a whole. Even if the waterproofing treatment is applied by covering the wire barrel by a heat shrinkable tube or the like instead of the resin material, the contact parts of the wire barrel cannot be covered without any clearance by the heat shrinkable tube, wherefore waterproofing performance is reduced.

The present invention was completed based on the above situation and aims to reduce a clearance formed at contact parts of a wire barrel.

SUMMARY OF THE INVENTION

The present invention is directed to a terminal fitting to be crimped to a wire including a core formed by putting a plurality of strands together, including a bottom plate portion on which the core is to be placed; and a pair of crimping pieces connected to the bottom plate portion and to be crimped to the core in such a manner as to embrace the core placed on the bottom plate portion; wherein butting parts of the respective crimping pieces are formed with a thinning portion, and a bent portion is formed by deforming the thinning portion when the respective crimping pieces are crimped to the core.

According to such a configuration, since the thinning portion is preferentially deformed by crimping to form the bent portion, a bending angle of the butting part of the crimping piece can be made smaller than in the case where the thinning portion is not provided. Thus, a clearance formed at the butting parts of the respective crimping pieces can be made smaller.

Each crimping piece may include an inner crimping piece to be arranged in the core and an outer crimping piece to be arranged outside the core, and the thinning portion may be formed between the inner and outer crimping pieces. According to such a configuration, the inner crimping piece is bent inwardly as crimping is performed, whereby the bent portion can be easily formed.

The thinning portion may be formed into a groove portion extending in an axial direction of the wire. According to such a configuration, the thinning portion can be more easily bent.

The thinning portion may be formed on each crimping piece. According to such a configuration, each bent portion is formed by deforming each thinning portion, and the clearance can be made smaller by butting the respective butting parts against each other.

A part of the crimping piece extending from the thinning portion toward a base end side may be formed into a flat portion. Further, the flat portion of one crimping piece and that of the other crimping piece may be flush with each other. According to such configurations, in covering each crimping piece with a resin material as a waterproofing treatment, the resin material can have a uniform thickness as a whole and a used amount of the resin material can be reduced. Further, in covering each crimping piece with a heat shrinkable tube as a waterproofing treatment, a clearance formed between the heat shrinkable tube and contact parts of a wire barrel can be made smaller.

The thinning portion may be formed on a side of the butting part of each crimping piece to be held in contact with the core. According to such a configuration, the thinning portion is formed on an inner part where the material tends to concentrate when the thinning portion is deformed, wherefore a bending angle of the bent portion can be made smaller.

The bent portion may be a corner portion. According to such a configuration, the clearance formed at the butting parts of the respective crimping pieces can be made smaller.

According to the present invention, it is possible to reduce a clearance formed at contact parts of a wire barrel.

DETAILED DESCRIPTION OF PREFERRED EMBODIMENTS

Figure 1:
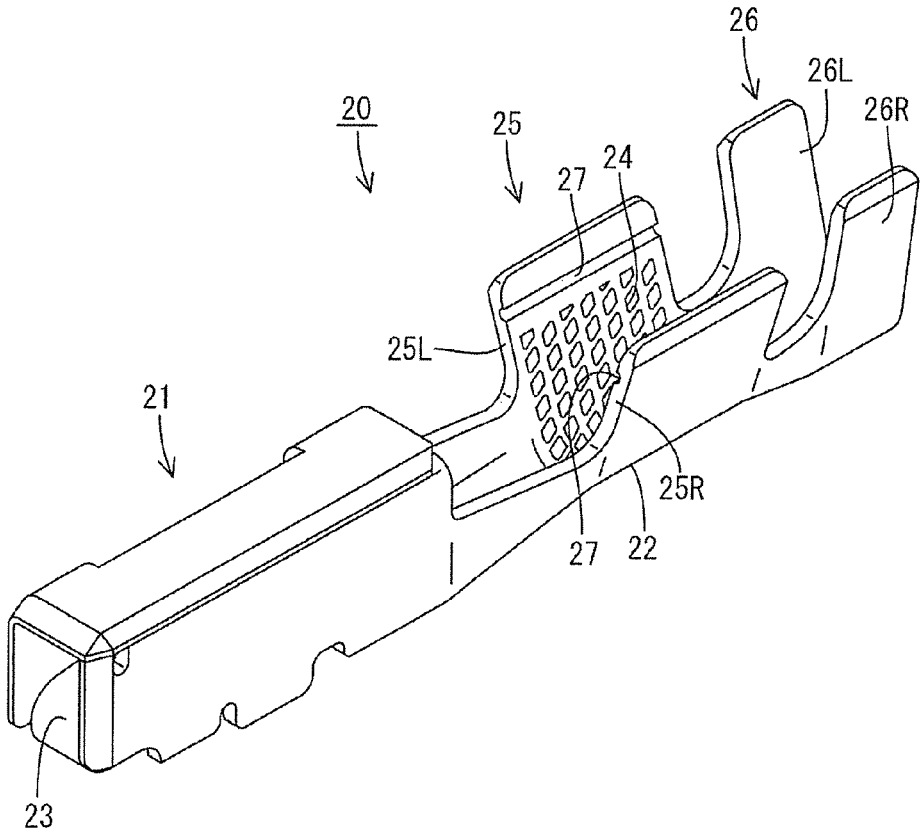
FIG. 1 is a perspective view showing a terminal fitting in a first embodiment.

A first embodiment of the present invention is described with reference to FIGS. 1 to 5. As shown in FIG. 1, a female terminal fitting 20 to be connected to an end of an aluminum wire (not shown) is illustrated in this embodiment. The aluminum wire is structured such that a core 12 is formed by twisting a plurality of strands 11 made of aluminum or aluminum alloy and covered by an insulation coating (not shown) made of synthetic resin.

The female terminal fitting 20 is formed by press-working a metal plate with good electrical conductivity made of copper alloy or the like, and structured such that a wire barrel 25 and an insulation barrel 26 are provided behind a terminal connecting portion 21 substantially in the form of a rectangular tube to be electrically connected to a mating male terminal fitting (not shown).

A resilient contact piece 23 folded back at the front edge of a bottom plate portion 22 is provided in the terminal connecting portion 21. A tab of the above mating male terminal fitting is inserted into this terminal connecting portion 21 from front and resiliently comes into contact with the resilient contact piece 23, whereby the male terminal fitting and the female terminal fitting 20 are electrically connected.

Figure 5:
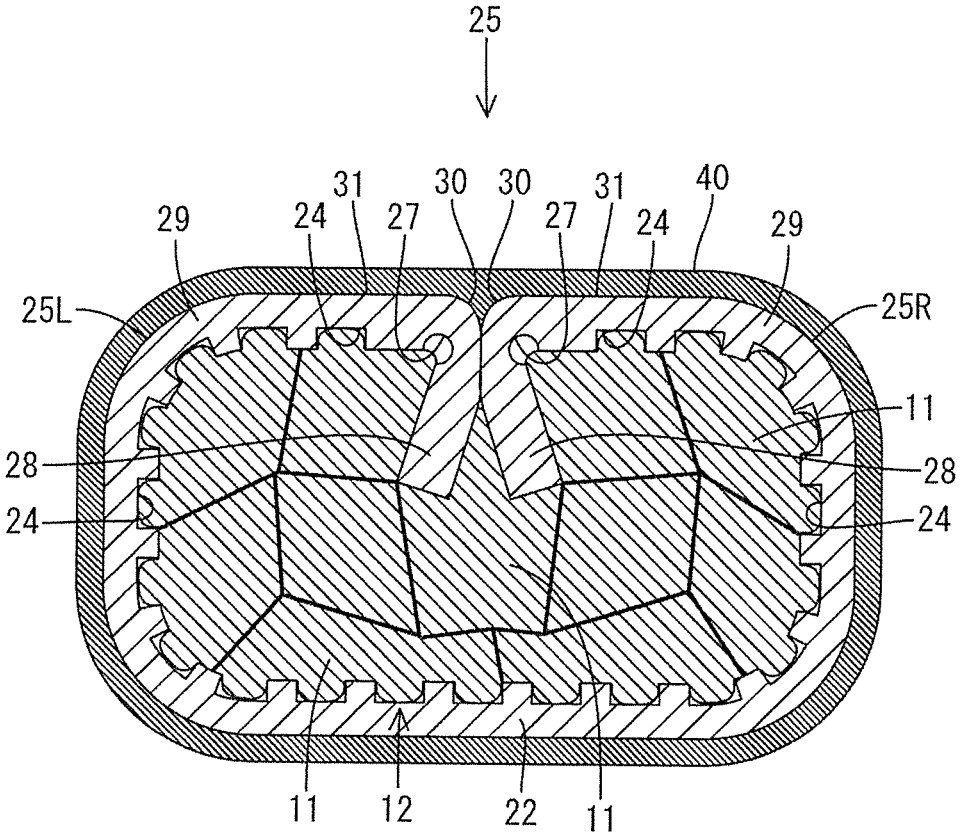
FIG. 5 is a section showing a state where a resin material is coated to apply a waterproofing treatment in a state of FIG. 4.

The wire barrel 25 is of an open barrel type and connected to the bottom plate portion 22 such that left and right wide barrel pieces 25L, 25R rise from left and right edges of the bottom plate portion 22 while facing each other. The wire barrel 25 is caulked and crimped to an end of the core 12 of the aluminum wire by vertically crimping the respective barrel pieces 25L, 25R. For example, as shown in FIG. 5, the barrel pieces 25L, 25R are so flattened and crimped to the core 12 as to surround the entire circumference of the end of the core 12 while later-described corner portions 30, 30 are butted against each other.

The insulation barrel 26 is likewise of an open barrel type and connected to the bottom plate portion 22 such that left and right barrel pieces 26L, 26R narrower and taller than the barrel pieces 25L, 25R of the wire barrel 25 rise from the left and right edges of the bottom plate portion 22 while facing each other. The insulation barrel 26 is caulked and crimped to an end of an insulation coating of the aluminum wire by vertically crimping the respective barrel pieces 26L, 26R. For example, the barrel pieces 26L, 26R are caulked in a so-called overlapping manner to embrace the outer periphery of the end of the insulation coating from opposite left and right sides while overlapping projecting ends thereof.

A plurality of recesses 24 are formed on a crimping surface (inner surface in FIG. 3) of the wire barrel 25. As shown in FIG. 1, these recesses 24 are bottomed recesses having a substantially parallelogram-like opening shape. The core 12 bites into the interior of each recess 24 by crimping. Edges of each recess 24 break an insulation film formed on the outer surface of the core 12 during this biting, whereby the core 12 and the edges of each recess 24 are electrically conductively connected.

Figure 3:
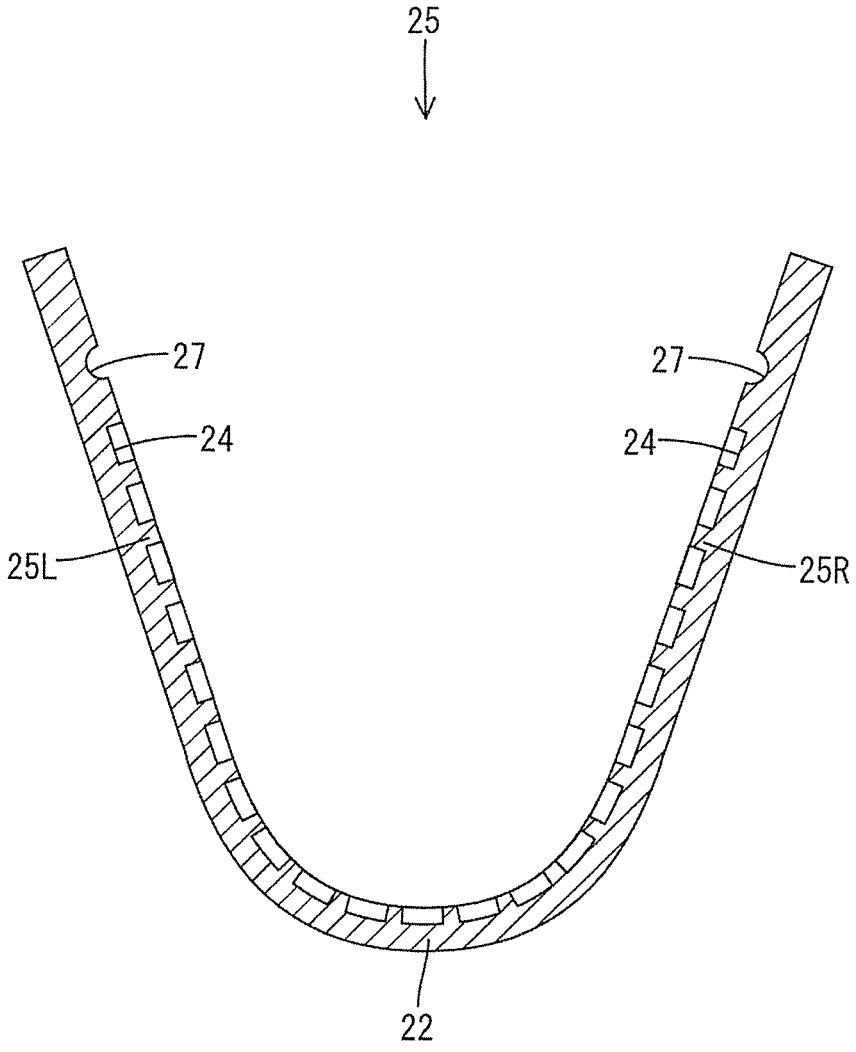
FIG. 3 is a section showing the wire barrel after bending is performed in the state of FIG. 2.

A thinning portion 27 IS formed on A tip part of EACH OF the respective barrel pieces 25L, 25R of the wire barrel 25 to be held in contact with the core 12. These thinning portions 27 are formed by being struck during press-working and extend in a front-back direction (axial direction of the wire) over the entire length from the front edges to the rear edges of the barrel pieces 25L, 25R. Further, as shown in FIG. 3, the thinning portions 27 have a semicircular cross-section.

In a state where the wire barrel 25 is crimped to the core 12, each of the barrel pieces 25L, 25R is composed of an inner crimping piece 28 arranged in the core 12 and an outer crimping piece 29 arranged outside the core 12 as shown in FIG. 5. The corner portion 30 is formed on an outer part between the inner and outer crimping pieces 28, 29 which does not come into contact with the core 12. This corner portion 30 is formed by bending the thinning portion 27 inwardly (toward the core 12), and a bending angle of the corner portion 30 is substantially a right angle and drastically smaller than in the case where the thinning portion 27 is not provided.

Further, parts of the respective barrel pieces 25L, 25R extending from the thinning portions 27, 27 toward a base end side are formed into flat portions 31, 31. These flat portions 31 are formed between the corner portions 30 and the recesses 24 closest to the corner portions 30. The flat portion 31 of one barrel piece 25L and that of the other barrel piece 25R are aligned and flush with each other in a horizontal direction (direction perpendicular to a crimping direction of the respective barrel pieces 25L, 25R). Specifically, in this embodiment, butting parts of the respective barrel pieces 25L, 25R are formed by butting the respective corner portions 30, 30 bent substantially at a right angle against each other. In other words, the wire barrel 25 is held in a closed state by butting the respective corner portions 30, 30 into close contact with each other.

A resin material 40 is coated on the outer periphery of the wire barrel 25 for sealing, whereby a waterproofing treatment is applied. The resin material 40 is formed to have a substantially uniform thickness, and the resin material 40 does not become extremely thick even at the butting parts of the respective corner portions 30, 30. That is, a clearance formed between the respective corner portions 30, 30 is made smaller by more proximately arranging the corner portions 30, 30 having a small bending angle. Even if the resin material 40 is filled into this clearance, the thickness of the resin material 40 can be suppressed to be small.

Figure 2:
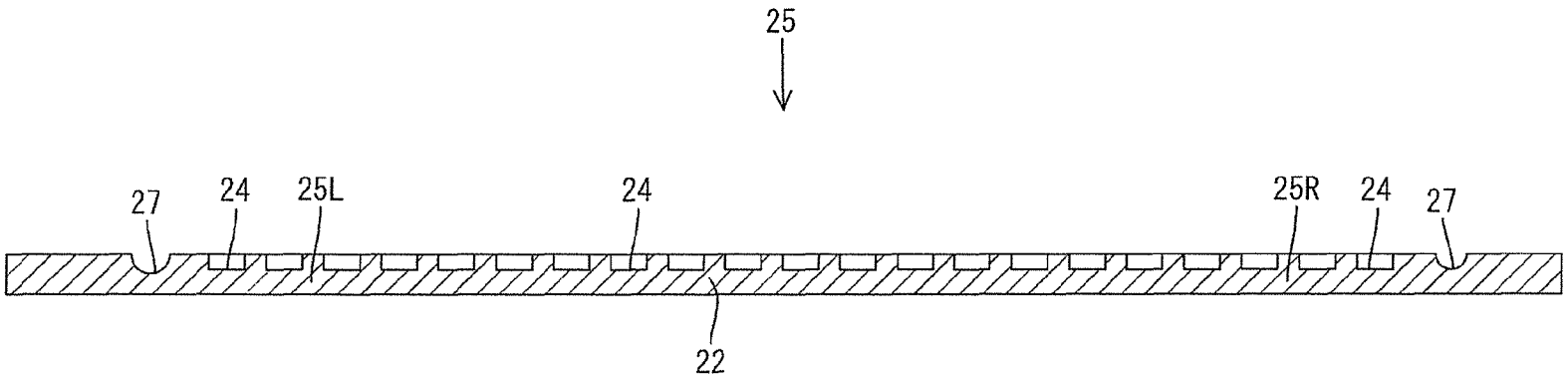
FIG. 2 is a section showing a wire barrel in a development state.

This embodiment is configured as described above. Next, a manufacturing process and a crimping process of the wire barrel 25 of the female terminal fitting 20 are briefly described with reference to FIGS. 2 to 5. FIG. 2 is a section showing the wire barrel 25 in a development state, and the metal plate as a base material of the female terminal fitting 20 is punched out into a predetermined shape. At this time, the plurality of recesses 24 are formed by recessing on the crimping surface of the wire barrel 25 and, simultaneously, the pair of thinning portions 27, 27 are formed by recessing on opposite left and right sides of the plurality of recesses 24.

Subsequently, as shown in FIG. 3, the bottom plate portion 22 is folded into a substantially U shape, whereby the respective barrel pieces 25L, 25R rise while facing each other. As a result, the wire barrel 25 shown in FIG. 1 is formed and the female terminal fitting 20 is completed.

Figure 4:
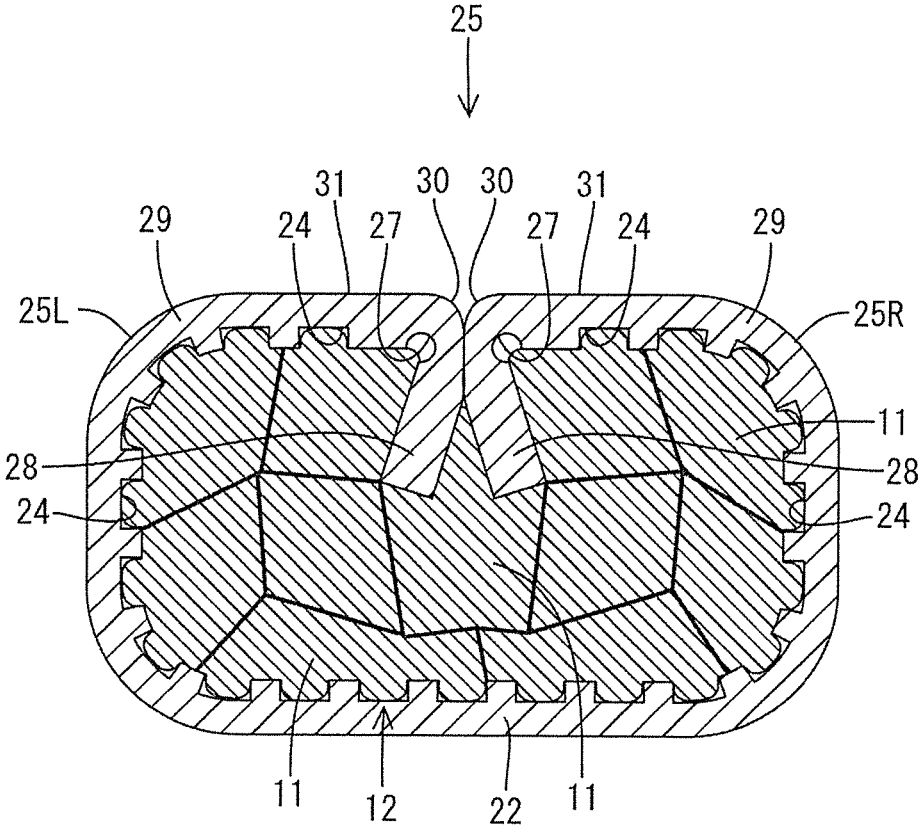
FIG. 4 is a section showing the wire barrel after being crimped to a core in the state of FIG. 3.

Thereafter, the core 12 is placed on the bottom plate portion 22 of the wire barrel 25 and the respective barrel pieces 25L, 25R are caulked and crimped to surround that core 12. At this time, as shown in FIG. 4, the tips of the respective barrel pieces 25L, 25R come into contact with a crimping die (not shown) and the inner crimping pieces 28 are bent inwardly at the thinning portions 27. Then, at the same time as the inner crimping pieces 28 are inserted into between the strands 11, the respective barrel pieces 25L, 25R are crimped to the core 12. Further, the thinning portions 27 are deformed to form the corner portions 30, and the wire barrel 25 are held in the closed state by butting these corner portions 30, 30 into close contact with each other.

Subsequently, the resin material 40 is coated on the outer periphery of the wire barrel 25 as shown in FIG. 5. The resin material 40 is formed to have a substantially uniform thickness and the interior of the wire barrel 25 is kept watertight. In this way, an anticorrosive effect of preventing the occurrence of electrolytic corrosion between different types of metals is exhibited.

As described above, since the pair of thinning portions 27, 27 are formed at the butting parts of the respective barrel pieces 25L, 25R and the corner portions 30 are formed by deforming the thinning portions 27, 27 in this embodiment, the clearance formed between the respective corner portions 30, 30 can be made smaller and the thickness of the resin material 40 filled into this clearance can be suppressed to be small.

Figure 6:
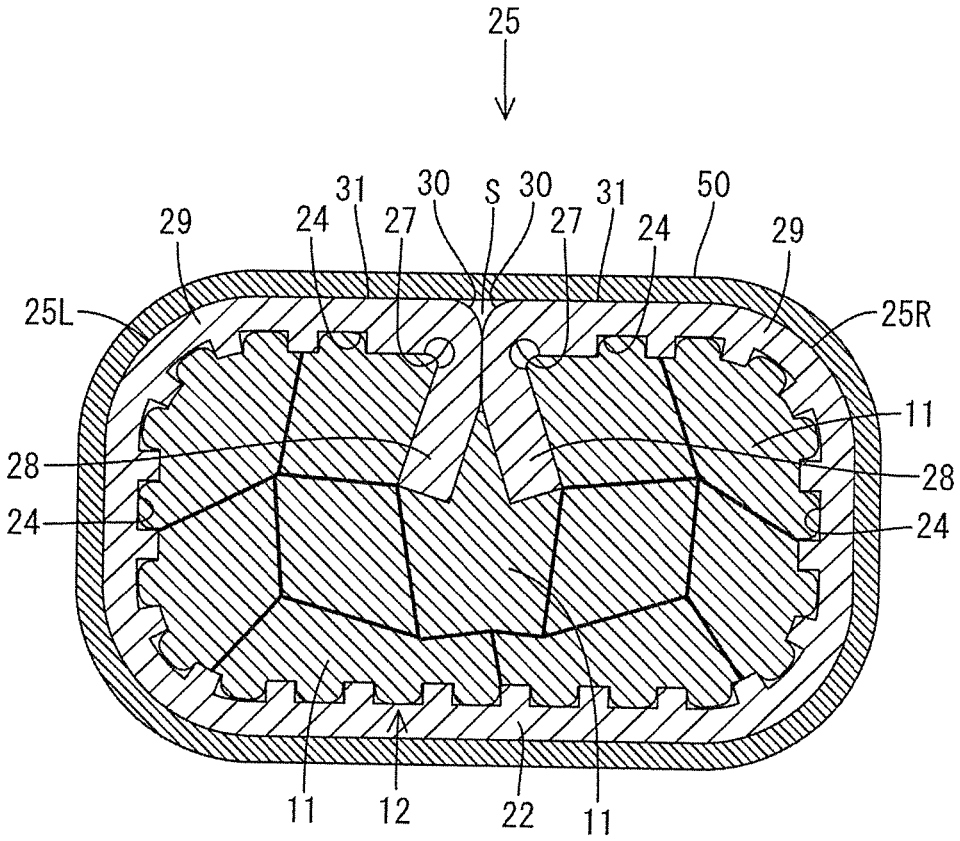
FIG. 6 is a section showing a state where a wire barrel is waterproofed by mounting a heat shrinkable tube instead of the resin material of the first embodiment.

A second embodiment of the present invention is described with reference to FIG. 6. In this embodiment, a waterproofing treatment is applied using a heat shrinkable tube 50 instead of the resin material 40 of the first embodiment. If a heating treatment is applied after the heat shrinkable tube 50 before shrinkage is mounted on a wire barrel 25, the heat shrinkable tube 50 shrinks to make the interior of the wire barrel 25 watertight. At this time, a small clearance S is formed between butting parts of corner portions 30, 30 and the heat shrinkable tube 50, but this clearance S is very small and has such a size as not to permit the entrance of water. Thus, a waterproofing effect and an anticorrosive effect are not lost.

The present invention is not limited to the above described and illustrated embodiments. For example, the following embodiments are also included in the technical scope of the present invention.

Although the thinning portions 27 formed into grooves extending in the front-back direction are illustrated in the above embodiments, through holes may be formed and conical thinning portions may be formed on hole edge parts of these through holes according to the present invention.

Although the pair of thinning portions 27, 27 are formed on the respective barrel pieces 25L, 25R in the above embodiments, a thinning portion may be formed only on either one of the barrel pieces according to the present invention.

Although the flat portions 31, 31 are formed on the parts of the barrel pieces 25L, 25R extending from the thinning portions 27, 27 toward the base end side in the above embodiments, curved portions may be provided instead of the flat portions and arranged to be aligned in flush with each other according to the present invention.

Although the thinning portions 27 are formed on the sides of the barrel pieces 25L, 25R to be held in contact with the core 12 in the above embodiments, they may be formed on sides opposite to the core 12 according to the present invention.

Although the corner portions 30 having a bending angle of about 90° are illustrated as bent portions in the above embodiments, bent portions having a bending angle of about 120° may be formed instead of the corner portions 30 according to the present invention.

Although the aluminum wire is illustrated in the above embodiments, the present invention may be applied to a copper wire including a core made of copper alloy or the like. Further, although the female terminal fitting is illustrated in the above embodiments, the present invention may be applied to a male terminal fitting including a tab. Further, although the twisted strands are illustrated in the above embodiments, the present invention may be applied to a straight core in which strands are not twisted.

The invention claimed is:

1. A terminal fitting to be crimped to a wire including a core formed by putting a plurality of strands together, comprising:

a bottom plate portion on which the core is to be placed; and a pair of crimping pieces connected to the bottom plate portion and to be crimped to the core in such a manner as to embrace the core placed on the bottom plate portion, each crimping piece including an inner crimping piece to be arranged in the core and an outer crimping piece to be arranged outside the core;

wherein butting parts of the respective crimping pieces are formed with a thinning portion between the inner and outer crimping pieces, and a bent portion is formed by deforming the thinning portion when the respective crimping pieces are crimped to the core.

2. The terminal fitting of claim 1, wherein the thinning portion is formed on a side of the butting part of each crimping piece to be held in contact with the core.

3. The terminal fitting of claim 1, wherein the thinning portion is formed into a groove portion extending in an axial direction of the wire.

4. The terminal fitting of claim 1, wherein the bent portion is a corner portion.

5. The terminal fitting to be crimped to a wire including a core formed by putting a plurality of strands together, comprising:

a bottom plate portion on which the core is to be placed; and a pair of crimping pieces connected to the bottom plate portion and to be crimped to the core in such a manner as to embrace the core placed on the bottom plate portion;

wherein butting parts of the respective crimping pieces are formed with a thinning portion, a bent portion is formed by deforming the thinning portion when the respective crimping pieces are crimped to the core, and a part of the crimping piece extending from the thinning portion toward a base end side is formed into a flat portion.

6. The terminal fitting of claim 5, wherein the flat portion of one crimping piece and that of the other crimping piece are flush with each other.

* * * * *